United States Patent [19]

Borenstein

[11] Patent Number: 4,954,822

[45] Date of Patent: Sep. 4, 1990

[54] TRAFFIC SIGNAL USING LIGHT-EMITTING DIODES

[76] Inventor: Arnold Borenstein, 2818 W. Chase, Chicago, Ill. 60645

[21] Appl. No.: 240,072

[22] Filed: Sep. 2, 1988

[51] Int. Cl.[5] ..... G08G 1/07

[52] U.S. Cl. ..... 340/925; 340/762; 340/907; 340/815.03; 362/800

[58] Field of Search ..... 340/114 R, 114 B, 84, 340/87, 762, 908, 925, 782, 723, 815.03, 907; 362/800

[56] References Cited

U.S. PATENT DOCUMENTS 4,271,408 6/1981 Teshima et al. ..... 362/800

4,298,869 11/1981 Okuro ..... 362/800

4,654,629 3/1987 Bezos et al. ..... 340/50

*Primary Examiner*—Donnie L. Crosland

*Attorney, Agent, or Firm*—Laff, Whitesel, Conte & Saret

[57] ABSTRACT

A traffic control device includes a housing having a display structure. The display structure includes a non-reflective support panel supporting a plurality of light emitting diode elements arranged in a configuration defining a traffic control symbol. The light emitting diode elements are high intensity limited dispersion L.E.D.'s which emit light in an attenuated angular spread about a central axis. The light emitting diode elements are supported on with their control axis generally parallel to each other and generally perpendicular to the support panel.

26 Claims, 3 Drawing Sheets

FIG. 4
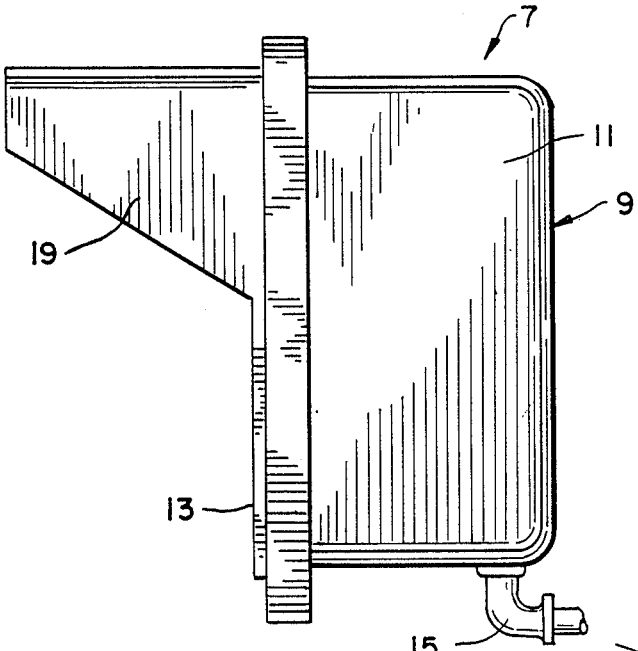
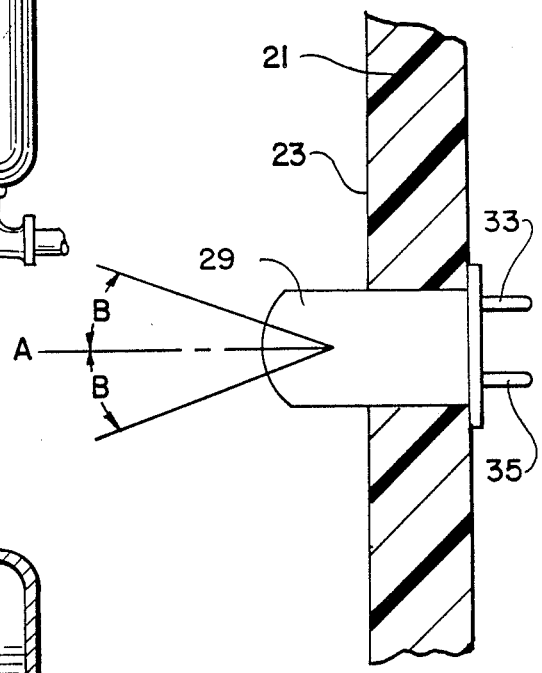
FIG. 6
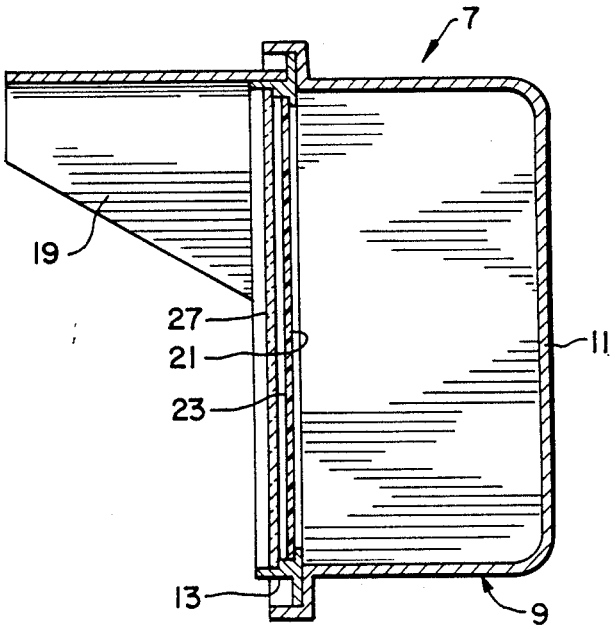
FIG. 5

TRAFFIC SIGNAL USING LIGHT-EMITTING DIODES

BACKGROUND OF THE INVENTION

1. Field of the Invention

This invention relates to traffic signals.

2. Description of the Prior Art

The conventional traffic signal device contains an incandescent lamp supported in the appropriate place in a reflection containment to provide generally parallel beams of light to illuminate the visible display of the traffic signal device. The incandescent lamps in conventional traffic signal devices usually consume between 69 and 135 watts of power, depending upon how much brightness is required to overcome ambient light conditions around the signal device. The life expectancy of these bulbs is generally in the area of 8,000 hours of burning time. The power demands of these incandescent lamps result in cost to the entity responsible for operation of the signal, and the lifetime of the lamp involves additional cost due to the need for work crews to replace the lamps relatively frequently. Also, the cost of manufacture of the signal is greater due to the cost of hinges, fasteners, and gaskets necessary to provide ready access to the interior for lamp replacement.

An additional problem with conventional traffic devices commonly occurs in a number of specific signal applications, particularly in pedestrian WALK/DON'T WALK signal devices. The usual arrangement of pedestrian signal devices is to have two displays, one display having a symbol indicating WALK, and the other display having a symbol indicating DON'T WALK. When sunlight shines on the signal displays, it will frequently produce what is known as phantom image. In a phantom image, the sunlight reflects off the display surface, which is usually reflective prismatic material similar to that used in automobile tail lights, and gives the false impression that the display is illuminated, when in fact it is not.

Reference is made to U.S. Pat. No. 4,308,572 which discloses the use of diodes in clothing or on fabric or other displays. However, none of these disclosures relate to traffic signals which have been made and tested by me to obtain a high resolution signal far superior to those presently in use and which can be easily seen in various weather conditions.

Signals have been provided with shades or hoods in an attempt to overcome this problem, but with only limited success, since it is very difficult to exclude sunlight from the display while providing visibility of the display to traffic.

SUMMARY OF THE INVENTION

Accordingly, it is an object of this invention to provide a traffic signal device which has low energy requirements and a long lifetime to reduce costs of operation. It is also an object to provide a traffic signal device which avoids the phantom image problem of the prior art.

This is achieved by providing a traffic signal device which comprises a non-reflecting panel which supports a number of high-intensity light-emitting diode (L.E.D.) elements. The L.E.D elements are organized in the shape of any symbol desired, such as international traffic control symbols, words, or a substantially solid field of color.

The L.E.D. elements have very low power demands, and have a life expectancy in the millions of hours at the voltage used in the present invention.

A plurality of symbols may be placed on the same panel of the traffic signal device in this invention, and the L.E.D. elements which make up each symbol are provided with separate power supplies so that the symbols may be displayed selectively. The L.E.D. elements do not have the reflective properties of the prismatic displays of conventional traffic signal devices, and therefore there is no problem of phantom image.

BRIEF DESCRIPTION OF THE DRAWINGS

FIG. 4 is a side view of the pedestrian traffic signal device.

FIG. 5 is a sectional view of the pedestrian traffic signal device taken along line 5—5 of FIG. 1.

FIG. 6 is a detailed view of one of the light emitting diode elements of the traffic signal device.

DETAILED DESCRIPTION OF THE INVENTION

FIGS. 1 to 6 disclose an embodiment of the traffic signal device of this invention.

Figure 1:
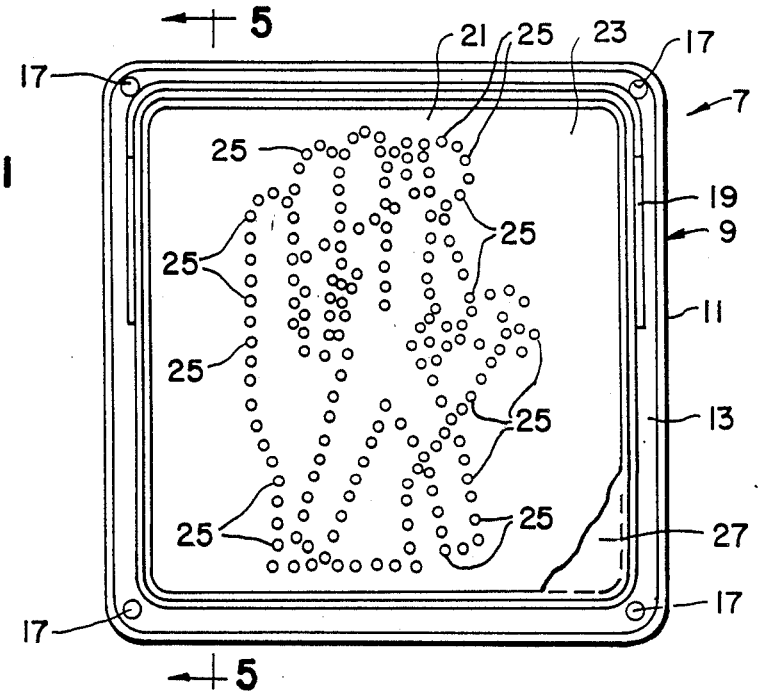
FIG. 1 is a front elevational view of an embodiment of the invention in the form of a pedestrian traffic signal device.

A pedestrian traffic signal device is generally indicated at 7. As best shown in FIGS. 1, 4 and 5, the signal device 7 includes a housing 9. The housing 9 includes a rear enclosure 11 and a display support structure 13 which together form a substantially enclosed box. Access conduit 15 secured to rear enclosure 11 communicates with the interior of the device 7, and supportive wiring for the signal device 7 such as wiring to a control device, or other wiring, extends through conduit 15 into the device 7. The display support structure 13 is secured to rear enclosure 11 by securement means, such as screws 17, to create a substantially weather-tight seal therebetween for protecting the components within the device. A visor or hood 19 is supported on the device to shade the display of the device in accordance with national standards.

The display support structure 13 includes a support plate portion 21 which has a substantially planar surface portion 23. A plurality of signal elements some examples of which are designated by reference character 25 are supported on support plate portion 21. A protective cover or shield plate 27 made of substantially transparent or non-opaque material such as acrylic material or polycarbonate is supported and spaced forwardly from the support panel 21 and the signal elements 25. Cover 27 substantially covers the front of the device, and is partially cut-away in FIGS. 1, 2, and 3.

Each of the signal elements 25 is a high intensity light emitting diode element or L.E.D. 29 supported on support panel 21, as best shown in FIG. 6. High intensity L.E.D.s differ from conventional light emitting diodes in the brilliance of output therefrom. Exemplary of this type of high intensity L.E.D. are the L.E.D.s sold by Hewlett-Packard under the brand name ULTRABRIGHT or DOUBLE-HETERO JUNCTION, AlGaAs.

The increased brilliance of the high intensity L.E.D. is achieved by changes in the chemistry of the doping material used in the L.E.D., and also by providing reflector structure or other attenuating means which limits the dispersion of light emitted by the L.E.D., so that the emitted light is primarily within a conical space defined by an acute angular displacement B from the central axis A of the L.E.D. The magnitude of angle B may vary depending on the L.E.D. used, but will generally be less than about 45 degrees, and preferably generally in the range of 4 to 30 degrees.

The L.E.D.'s 29 are supported on the display support structure 21 so that the central axes A of the L.E.D.s are generally parallel to each other for optimal visibility of the display. As are best shown in FIG. 6, each L.E.D. 29 is supported in an aperture 31 in support plate 21 so that the central axis of the L.E.D. 27 is substantially perpendicular to the surface 23 of support plate 21. Each L.E.D. has two leads 33 and 35, and when current is applied through leads 33 and 35 the L.E.D. 29 becomes illuminated. The surface 23 is non-reflective to provide a dark, contrasting back drop to the L.E.D. 29 when illuminated.

The signal elements 25 are organized in sets of signal elements which are positioned on the support plate portion 21 in configuration or patterns corresponding to or defining traffic control symbols. In the first embodiment shown, the signal elements are organized in two sets, one set corresponding to a stylized figure of a walking humanoid (the international symbol for "WALK") and the other set corresponding to an upraised hand (the international symbol for DON'T WALK). The precise shape of these symbols is defined by the Institute of Traffic Engineer (ITE). The signal elements 25 are arranged in single file around the perimeter of the symbol. The spacing between the L.E.D.s is between about ¼ inch and ½ inch, with the optimal distance determined by the requirements of the display.

Figure 2:
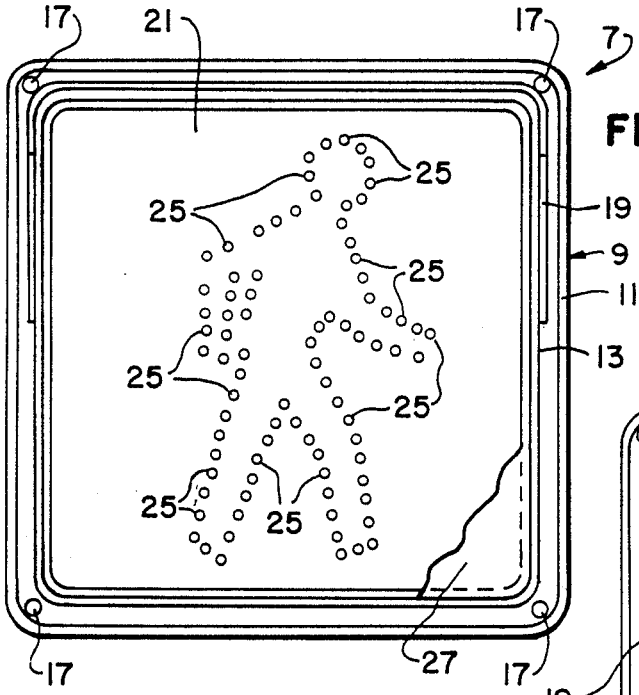
FIG. 2 is a view as in FIG. 1, but showing the symbol which is visible to pedestrians when the WALK symbol is illuminated.
Figure 3:
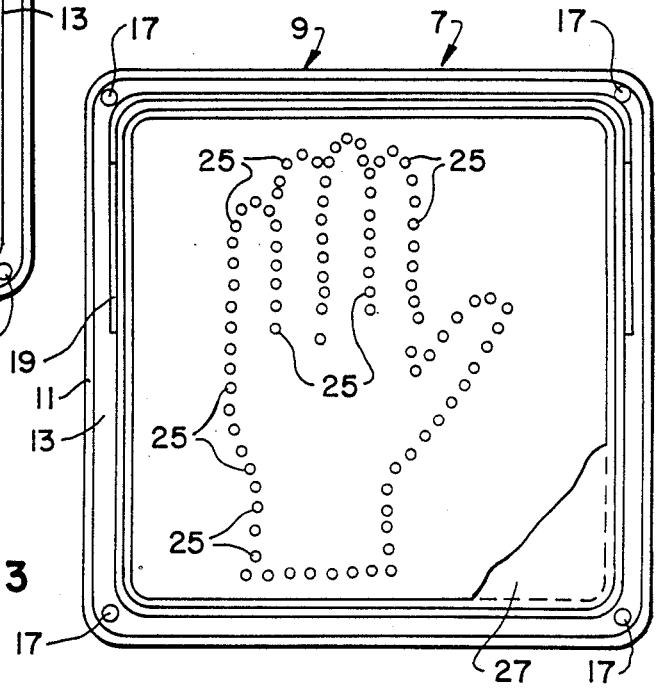
FIG. 3 is a view as in FIG. 1, but showing the symbol which is visible to pedestrians when the DON'T WALK symbol is illuminated.

The distinct sets of signal elements 25 best shown in FIGS. 2 and 3. FIG. 2 shows those signal elements 25 which are illuminated to display the WALK symbol, and FIG. 3 shows those signal elements which are illuminated to display the DON'T WALK symbol. The L.E.D.s are available in a variety of colors, and in the preferred embodiment, red L.E.D.'s are used for the DON'T WALK symbol, and green L.E.D.'s are used for the WALK symbol.

Figure 7:
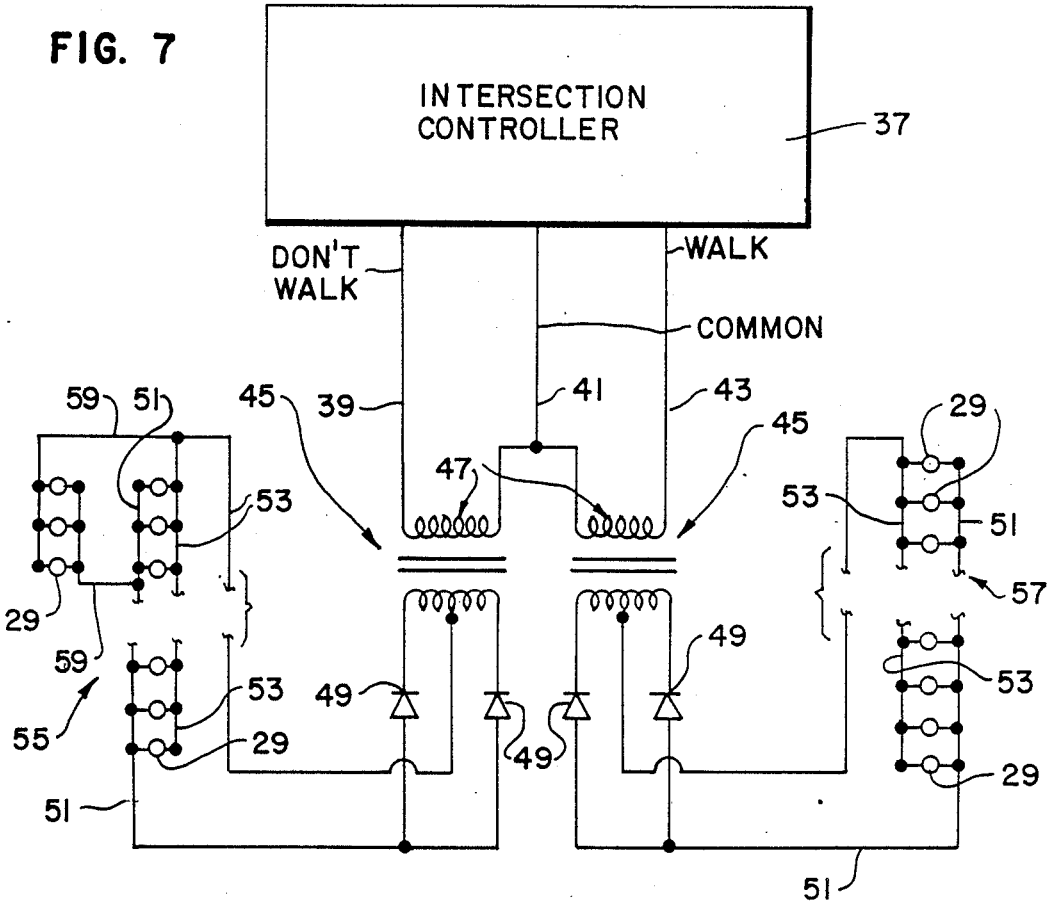
FIG. 7 is a schematic view of the circuit of the pedestrian traffic signal device.

A general schematic of the traffic signal device 7 is shown in FIG. 7. The power supply which provides electrical current to the signal elements 25 includes a controller indicated at 37 which controls the signals at an intersection or other location, as is well known in the art. The controller 37 is normally external to the traffic control device 7, and includes communicating wires 39, 41, and 43 which extend to the traffic signal device 7. The controller 37 selectively supplies one side of a 115 volt alternating current supply to wire 39 to activate the DON'T WALK signal, and to wire 43 to activate the WALK signal. Wire 41 carries a common opposite side of the alternating current to complete the circuit when current is applied to either wire 39 or 43.

Each wire 39 and 43 connects with a respective full phase rectifier indicated at 45. The rectifiers 45 each include a step down center tap transformer 47 which reduces the peak voltage to less than 6 volts and preferably to between 1 and 3 volts. In the preferred embodiment the peak voltage applied to the L.E.D.s is approximately 2.1 volts, at which voltage the life expectancy of the high intensity L.E.D.s is in the millions of hours. Diodes 49 direct the positive side of the transformer output to conductor 51 and the center tap of the transformer connects the negative side to conductor 53, yielding low voltage full-wave rectified direct current.

The set of L.E.D.'s 29 representing the DON'T WALK symbol is indicated at 55 and the set of L.E.D.'s 29 representing the WALK symbol is indicated at 57. Conductor 51 is connected to one lead 33 of each L.E.D. 29 in the associated set, and conductor 53 is connected to the other lead 35 of each L.E.D. 29 in the set. If the shape of the traffic symbol requires it, the conductors 51 and 53 may be provided with branch portions 59 to contact all L.E.D.'s 29 in the set. The L.E.D.'s 29 are wired in parallel, so that in the event of failure of an L.E.D., the remaining L.E.D.'s remain operable.

To reduce the cost of manufacturing, the conductors 51 and 53 may take the form of conductive material secured to a board member, as in a printed circuit board. The support plate 21 may be the board of a printed circuit board, having the conductors 51 and 53 applied to the rear surface thereof, and having non-reflective material on the forward surface 23 thereof.

If it is desired to operate the signal at a reduced intensity, a switch may be provided to interrupt current through one of the diodes 49, with the result that the output is half-wave rectified direct current. Another method of reducing the intensity of the L.E.D.s is to circumvent the diodes 49 and apply low voltage alternating current to the L.E.D.s.

The longevity of the L.E.D.s significantly reduces the cost of maintenance of the traffic signal device. In addition, the L.E.D.s require very little power to operate. To appreciate the energy efficiency of traffic signal devices of this invention, it should be appreciated that the pedestrian traffic signal device 7 described above uses less than 5 watts of power, in contrast to conventional incandescent traffic signal lights which normally use 60 watts or more of power. This invention accordingly results in a savings of more than 90% on energy cost of operating the device.

Additionally, the displays of this invention are not reflective, and therefore present no phantom image problem.

It will be understood that while a pedestrian signal has been shown above, the benefits of this invention may be applied to a variety of traffic control signal applications other than pedestrian signals, such as intersection lights and indicators. The traffic symbol used can vary widely, and may include pictorial symbols, actual words such as WALK, DON'T WALK or STOP, or the signal elements may be grouped together to form a substantially solid field of color when illuminated, as in a basic intersection traffic light.

Figure 8:
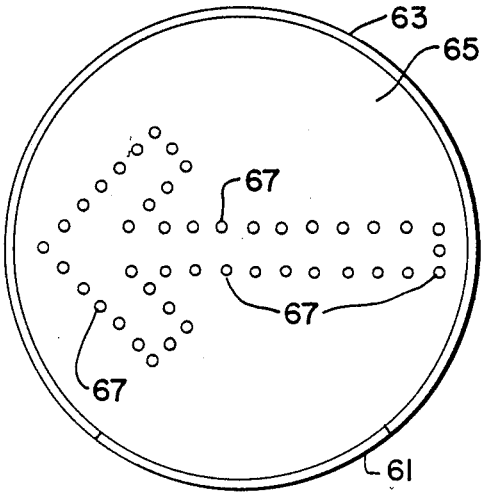
FIG. 8 is a front elevational view of a further embodiment of the invention in the form of a directional signal.

FIG. 8 discloses a alternate embodiment of the invention in the form of a directional arrow. The housing 61 is generally circular and has a visor 61 extending about 300 degrees therearound. A display support structure 65 supports a plurality of high intensity L.E.D. signal elements 67 which are wired in parallel and connected with a power supply similar to that used with the pedestrian signal described above. The signal elements are arranged in a pattern of an arrow.

Figure 9:
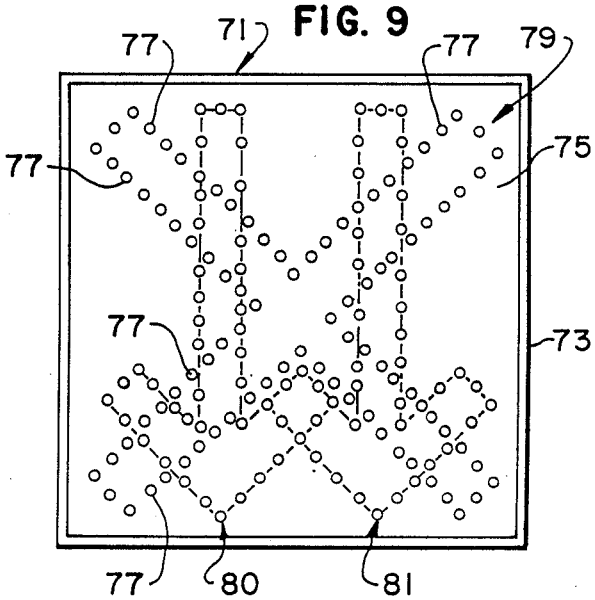
FIG. 9 is a front elevational view of an alternate embodiment of the invention in the form of a reversible lane traffic control device.

FIG. 9 discloses another alternate embodiment of the invention in the form of a reversible lane control signal device. The housing 71 includes a display support structure 73 which includes a support panel 75 which supports a plurality of high intensity L.E.D. signal elements 77 similar to those described above. The signal elements 77 are organized in three patterns which are connected with a power supply for independent illumination of each of the patterns One of the patterns is an X, generally indicated at 79. The other two patterns are laterally spaced patterns of downward-pointing arrows generally indicated at 80 and 81. The L.E.D. elements 77 which make up the X pattern 79 are red in color. The L.E.D. elements 77 which define one of the arrows 80 and 81 are amber or yellow in color, and the L.E.D. elements 77 which make up the other of the arrows 80 and 81 are green in color.

While specific embodiments have been disclosed herein, the invention is not limited thereto, and the language used is this specification is intended as descriptive rather than limiting, as those skilled in the art with this specification before them will be able to make modifications therein without departing from the spirit of the invention claimed.

Wherefore I claim:

1.

a street traffic signal device for providing a high resolution signal to vehicular and pedestrian traffic comprising:

a display support structure including a non-reflective panel member which is substantially flat;

a set of signal elements supported on said panel in a configuration corresponding to a traffic control symbol;

each of the signal elements comprising a high intensity light emitting diode element having an angle of dispersion about a central axis which is substantially perpendicular to said panel member; and power supply means for supplying electrical power being connected with said light emitting diode elements, and light emitting diode elements generating light responsive to power being applied thereto, said power supply means including a center tap secondary winding of a step down transformer having a first outboard tap, a second outboard tap and a center tap;

a first diode in a first conductor connected to said first outboard tap; and a second diode in a second conductor connected to said second output tap;

said diodes being commonly oriented to selectively allow conduction in the first and the second conductor whereby the traffic control symbol formed by illuminated diodes is only perceived by traffic when the diodes are illuminated.

2. The invention according to claim 1, and said light emitting diode elements each having a central axis and emitting light primarily within an acute angular range of about 12.5 degrees about the central axis, the light emitting diode elements being positioned on a display support structure so that the central axis of said light emitting diode elements are generally parallel to each other and perpendicular to the surface of said panel for optimal visibility of the traffic symbol.

3. The invention according to claim 1, and said light emitting diode elements having an angle of dispersion of less than 45 degrees from a central axis thereof of light generated thereby, and said light emitting diode elements being supported so that the central axis of each of the light emitting diode elements is generally perpendicular to said panel member, so that the light emitted from said diodes is directly perceived by traffic as the traffic symbol.

4. The invention according to claim 1, and wherein said light emitting diodes are connected in parallel.

5. The invention according to claim 1, and a substantially planar non-opaque cover means spaced from the panel member and covering the light emitting diode element, aid light emitting diode elements only being visible through said cover means when said light emitting diode elements are illuminated.

6. The invention according to claim 5, and said cover means comprising a plate of substantially transparent material selected from the group consisting of acrylic material and polycarbonate material.

7. The invention according to claim 1, and said light emitting diode elements being positioned substantially only in single file generally along only the perimeter of the represented traffic control symbol so that the outline of the traffic control symbol is perceived.

8. The invention according to claim 7, and each of the light emitting diode elements being spaced generally in the range of from about one fourth inch to about one half inch center to center from the nearest adjacent light emitting diode elements forming a single illuminated traffic control symbol.

9. The invention according to claim 1, and said light emitting diode elements being wired in parallel relative to each other.

10. The invention according to claim 1, and said light emitting diode elements each having first and second leads connected thereto, said light emitting diode element generating light when current is applied to flow through said leads, a first conductor being connected with the first leads of the light emitting diode elements;

a second conductor connected with the second leads of the light emitting diode elements;

the power supply means having first and second electrically opposite conductor portions connected with the first and second conductors respectively, whereby the light emitting diode elements are wired in parallel.

11. The invention according to claim 10, and said conductors comprises conductive material secured to a panel member.

12. The invention according to claim 11, and said panel and said conductors are an etched printed circuit board.

13. The invention according to claim 1, and the power supply means comprising a controller selectively supplying the flow of electrical power to the light emitting diode elements forming a single illuminated traffic control signal.

14. The invention according to claim 13, and
the power supply means including a source of alternating current, and
converter means for converting the alternating current to relatively lower voltage direct current, said converter means being connected with the light emitting diode elements and providing the lower voltage direct current thereto.

15. The invention according to claim 14, and
said converter means including a full wave rectifier converting said alternating current to direct current having a peak voltage generally between about 1 and about 6 volts.

16. The invention according to claim 15, and
said full wave rectifier converting said alternated current to direct current having a peak voltage of from about 1 to about 3 volts.

17. The invention according to claim 12, and
said first set of signal elements being supported in generally the configuration of an arrow.

18. A high resolution traffic signal device comprising:
a display support structure including a flat non-reflective panel support;
a first set of signal elements supported on the panel support in a configuration corresponding to a first traffic control symbol;
a second set of signal elements supported on the panel support in a configuration corresponding to a second traffic control symbol;
each of the signal elements comprising a high intensity light emitting diode element, and
power means for supplying electrical current to said light emitting diode elements, said power means including a first supply means for transmitting electrical current connected with the light emitting diode elements of the first set of signal elements, a second supply means for transmitting electrical current connected with the light emitting diode elements of the second set of signal elements, said first and said second supply means including
a center tap secondary winding of a step down transformer having a first outboard tap, a second outboard tap and a center tap;
a first diode in a first conductor connected to said first outboard tap; and
a second diode in a second conductor connected to said second output tap;
said diodes being commonly oriented to selectively allow conduction in the first and the second conductor; and a controller means for selectively controlling the flow of electrical current in said first and second supply means to the light emitting diode elements, whereby the controller means selectively causes the illumination of the first and second sets of signal elements to selectively make visible the first and second traffic symbols.

19. The invention according to claim 18, and
said light emitting diode elements each having a central axis and emitting light primarily within an acute angular range of about 12.5 degrees about the central axis,
the light emitting diode elements being positioned on the panel support so that the central axis of said light emitting diode elements are generally parallel to each other for optimal visibility of the traffic symbols.

20. The invention according to claim 18 wherein:
said first set of signal elements emits red light; and
said second set of signal elements emits green light.

21. A modular pedestrian traffic signal device connected to a conventional vehicular traffic signal and sharing a common supply of power comprising:
a housing including a substantially planar support portion;
a plurality of light emitting diode elements supported on the support portion in a pattern defining a traffic control symbol, each diode element of the plurality defining the traffic control symbol being in electrical parallel with the remaining diode elements of the plurality defining the traffic control symbol and the light emitted from said diodes being directly perceivable by a pedestrian as the traffic control symbol;
power supply means for transmitting electrical current being connected with the common source of power and supplying a common voltage to each of the light emitting diode elements;
said light emitting diode elements being directional high-intensity limited dispersion light emitting diode elements, and emitting light primarily in the general direction of a central axis of the element responsive to application of electrical current thereto;
said light emitting diode elements being positioned so that the central axis thereof are generally parallel and generally perpendicular to the substantially planar support portion for optimal visibility of the symbol;
said power supply means including a controller means for selectively controlling the flow of electrical current to the light emitting diode elements, and selectively illuminating and extinguishing the light emitting diode elements to display the traffic control symbol when desired.

22. The invention according to claim 21, and
said support portion having a substantially non-reflective surface portion providing a contrasting back drop to the light emitting diode elements when illuminated.

23. A street traffic signal device for providing a high resolution signal to vehicular and pedestrian traffic comprising:
a display support structure including a non-reflective panel member which is substantially flat;
a set of signal elements supported on said panel in a configuration corresponding to a traffic control symbol;
each of the signal elements comprising a high intensity light emitting diode element having an angle of dispersion about a central axis which is substantially perpendicular to said panel member, each diode in the set being connected in electrical parallel with every other diode in the set; and
power supply means for supplying electrical power being connected with said light emitting diode elements, and light emitting diode elements generating light responsive to power being applied thereto, whereby the traffic control symbol formed by illuminated diodes is only perceived by traffic when the diodes are illuminated.

24. The invention according to claim 23, and
said cover means comprising a plate of substantially transparent material selected from the group consisting of acrylic material and polycarbonate material.

25. The invention according to claim 23, and said light emitting diode elements being positioned substantially only in single file generally along only the perimeter of the represented traffic control symbol so that the outline of the traffic control symbol is perceived.

26. The invention according to claim 23, and each of the light emitting diode elements being spaced generally in the range of from about one fourth inch to about one half inch center to center from the nearest adjacent light emitting diode elements forming a single illuminated traffic control symbol.

* * * * *